United States Patent [19]

Cohen et al.

[11] Patent Number: 4,688,878

[45] Date of Patent: Aug. 25, 1987

[54] ELECTRICAL CONNECTOR FOR AN ELECTRICAL CABLE

[75] Inventors: Thomas S. Cohen, Wormleysburg; Ronald C. Laudig, Mechanicsburg; Donald L. Smith, Middletown, all of Pa.

[73] Assignee: AMP Incorporated, Harrisburg, Pa.

[21] Appl. No.: 838,335

[22] Filed: Jan. 22, 1986

Related U.S. Application Data

[63] Continuation-in-part of Ser. No. 716,075, Mar. 26, 1985, abandoned, and a continuation-in-part of Ser. No. 746,919, Jun. 20, 1985, abandoned.

[51] Int. Cl.[4] ..... H01R 17/18

[52] U.S. Cl. ..... 439/585

[58] Field of Search ..... 339/177 R, 177 E, 276 R, 339/89 C, 90 C

[56] References Cited

U.S. PATENT DOCUMENTS

| | | | |
|---|---|---|---|
| 2,870,420 | 1/1959 | Malek | 339/177 |
| 2,995,718 | 8/1961 | Murphy | 339/177 R |
| 3,107,135 | 10/1963 | Keil | 339/177 |
| 3,539,976 | 11/1970 | Reynolds | 339/177 E |
| 3,613,050 | 10/1971 | Andrews | 339/177 |
| 3,699,504 | 10/1972 | Huber | 339/177 R |
| 3,982,060 | 9/1976 | Avery et al. | 339/177 |
| 4,255,011 | 3/1981 | Davis et al. | 339/177 R |
| 4,280,749 | 7/1981 | Hemmer | 339/177 |
| 4,307,926 | 12/1981 | Smith | 339/177 |
| 4,397,516 | 8/1983 | Koren et al. | 339/177 |
| 4,431,254 | 2/1984 | Cartesse | 339/177 |
| 4,445,745 | 5/1984 | Cartesse | 339/177 |
| 4,456,323 | 6/1984 | Pitcher et al. | 339/177 R |

FOREIGN PATENT DOCUMENTS 2462798 2/1979 France .

*Primary Examiner*—Gil Weidenfeld
*Assistant Examiner*—David Pirlot
*Attorney, Agent, or Firm*—Gerald K. Kita

[57] ABSTRACT

An electrical connector (1, 2) for twin axial cable (100,100) comprises; a first assembly (4,4) comprised of a conductive outer shell (6,6), a first dielectric body (8,8), a conductive inner shell (10,10), and a second dielectric body (12,12); a second assembly (60,60) for insertion in the outer shell (6,6) and for electrical connection with the inner shell (10,10) comprises a first conductive body (62,62) a conductive ferrule (64,64) on the first conductive body (62,62) for connection with a corresponding electrical conductor (104,104), a third dielectric body (66,66), an electrical contact (70,70) for connection with a corresponding electrical conductor (102,102) of a twin axial cable (100,100), and a second conductive body (72,72) for establishing electrical connection of a conductive sheath (106,106) of a twin axial cable (100,100) and a barrier (108,108) in the outer shell (6,6) for limiting displacement of the conductive sheath (106,106) along the outer shell (6,6).

17 Claims, 9 Drawing Figures

6
8
34
10
44
12
56
70
66
62
78
68
64
108
110
104
102
106
100
80
68
78
64

ELECTRICAL CONNECTOR FOR AN ELECTRICAL CABLE

The Government has rights in this invention pursuant to Contract No. AF33657-81-C-0067 awarded by the Department of Defense.

This application is a continuation-in-part of U.S. patent application Ser. No. 716,075 filed Mar. 26, 1985, and a continuation-in-part of U.S. patent application Ser. No. 746,919, filed June 20, 1985, entitled "Electrical Connector For a Twin Axial Cable" both now abandoned. The invention relates to the field of electrical connectors, and is directed to an electrical connector for a twin axial electrical cable in which a pair of insulated conductors are contained in a conductive sheath of metal braid and an outer jacket of insulation material.

A twin axial electrical cable is required to transmit electrical signals over its length and also to shield against undesired escape of the signals from the cable as radio frequency interference (RFI) or electromotive interference (EMI). An insulated conductor within the cable transmits the electrical signals along the length of the cable. A second insulated conductor within the cable is twisted together with the first insulated conductor to form a twisted pair of conductors. The second insulated conductor is provided to absorb signals escaping from the first insulated conductor. Both insulated conductors of the twisted pair are encircled or surrounded by a conductive jacket known as a braid, so called for being composed of strands of wire which are interwoven to form a braid-like jacket. The conductive jacket is provided to absorb signals escaping from the first insulated conductor.

A prior connector for coaxial cable is disclosed in U.S. Pat. No. 4,280,749, July 28, 1981, in which an outer shell has an enlarged open rearward end to receive a conductive jacket of a coaxial cable. The jacket is doubled back on itself to coaxially surround a bushing that grips the jacket and is inserted with the jacket in the rearward end of the outer shell.

A known connector disclosed in U.S. Pat. No. 4,397,516 provides electrical connections to each of two insulated conductors of a twin axial cable and to a conductive jacket of the cable. The known connector is constructed of many separate parts which are assembled, in turn, slidably along the insulated conductors. The separate parts must be assembled in precise order along the insulated conductors.

The invention resides in a connector in which certain of the component parts are first assembled to one another in a corresponding assembly that is easily applied to corresponding conductors of an electrical twin axial cable. The assembly is less likely to result in parts which become forgotten or parts which are applied to the conductors of the cable in incorrect order.

An object of the invention is to provide a connector which provides electrical connections to each of a pair of insulated wires and a conductive jacket of an electrical cable, and shielding of electrical signals transmitted along one of the insulated conductors, and coupling of the insulated conductors and the conductive jacket to a complementary connector assembly.

Another object is to provide a connector for twin axial electrical cable in which the component parts of the connector assembly are separated by clearance spaces that permit ease in assembly of the component parts and that introduce impedance mismatching without reducing the effectiveness of shielding provided by the connector assembly.

Another object is to provide a connector which, in turn, provides electrical connections to each of a pair of insulated conductors and to a conductive jacket of an electrical cable, and which further provides means for insulating the conductive jacket from the electrical connections established with the insulated conductors.

Figure 1:
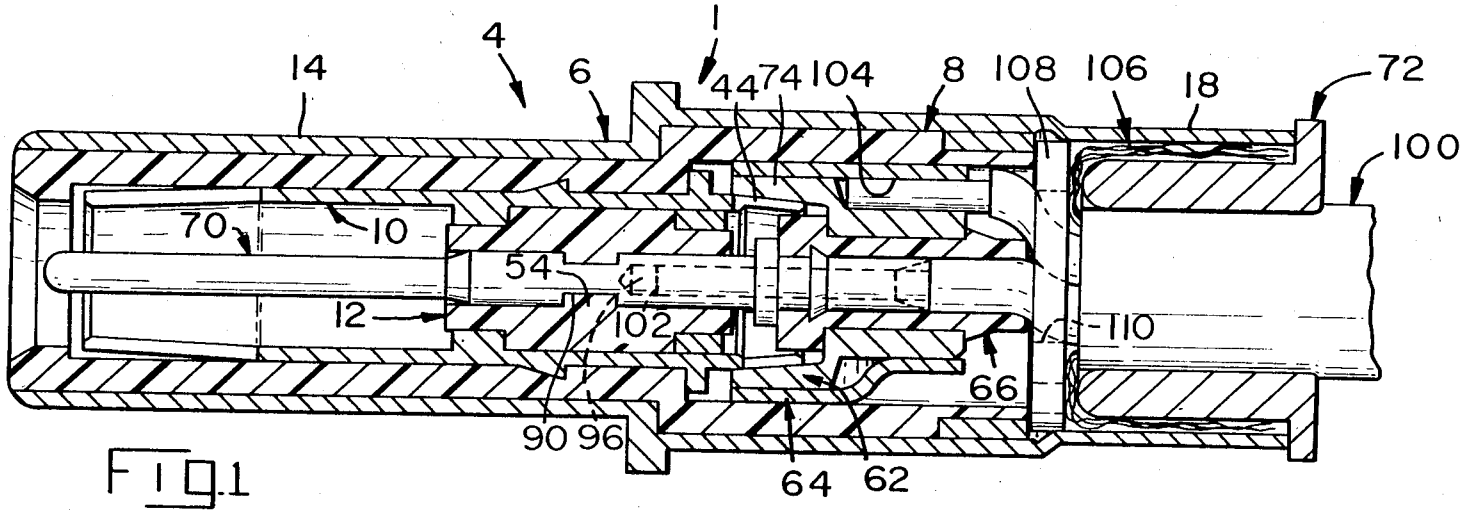
FIG. 1 is an enlarged fragmentary view in section of a plug type connector of the invention.
Figure 5:
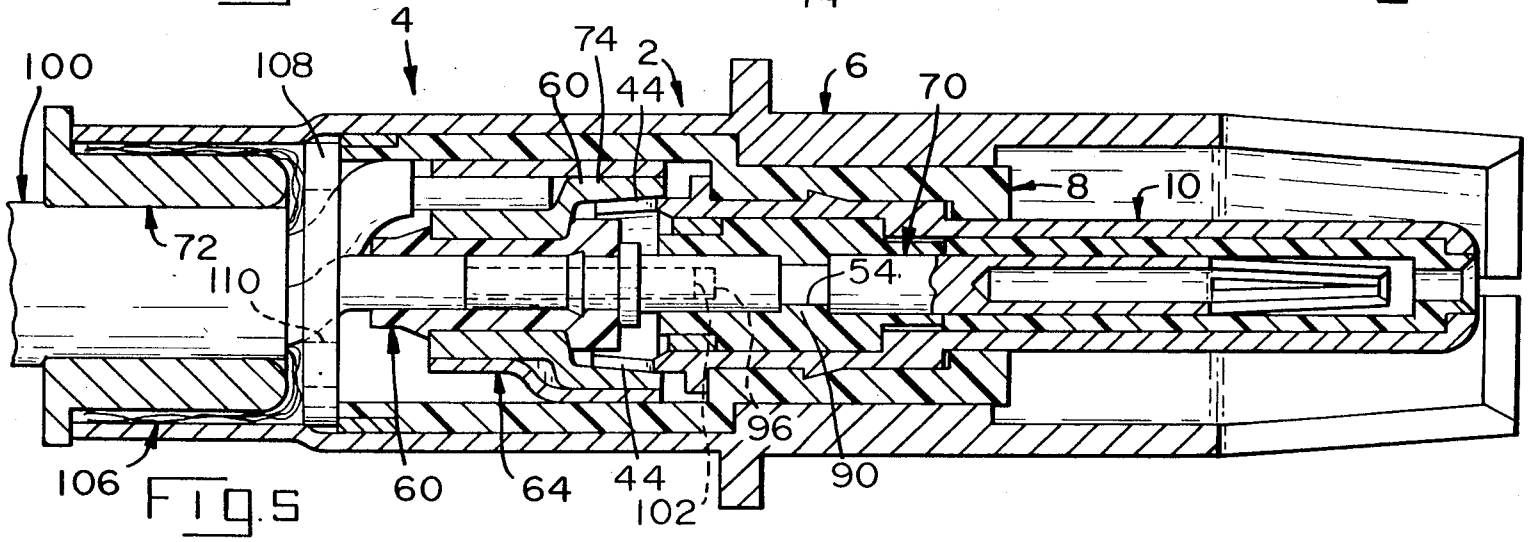
FIG. 5 is an enlarged fragmentary view in section of a receptacle type connector of the invention.
Figure 4:
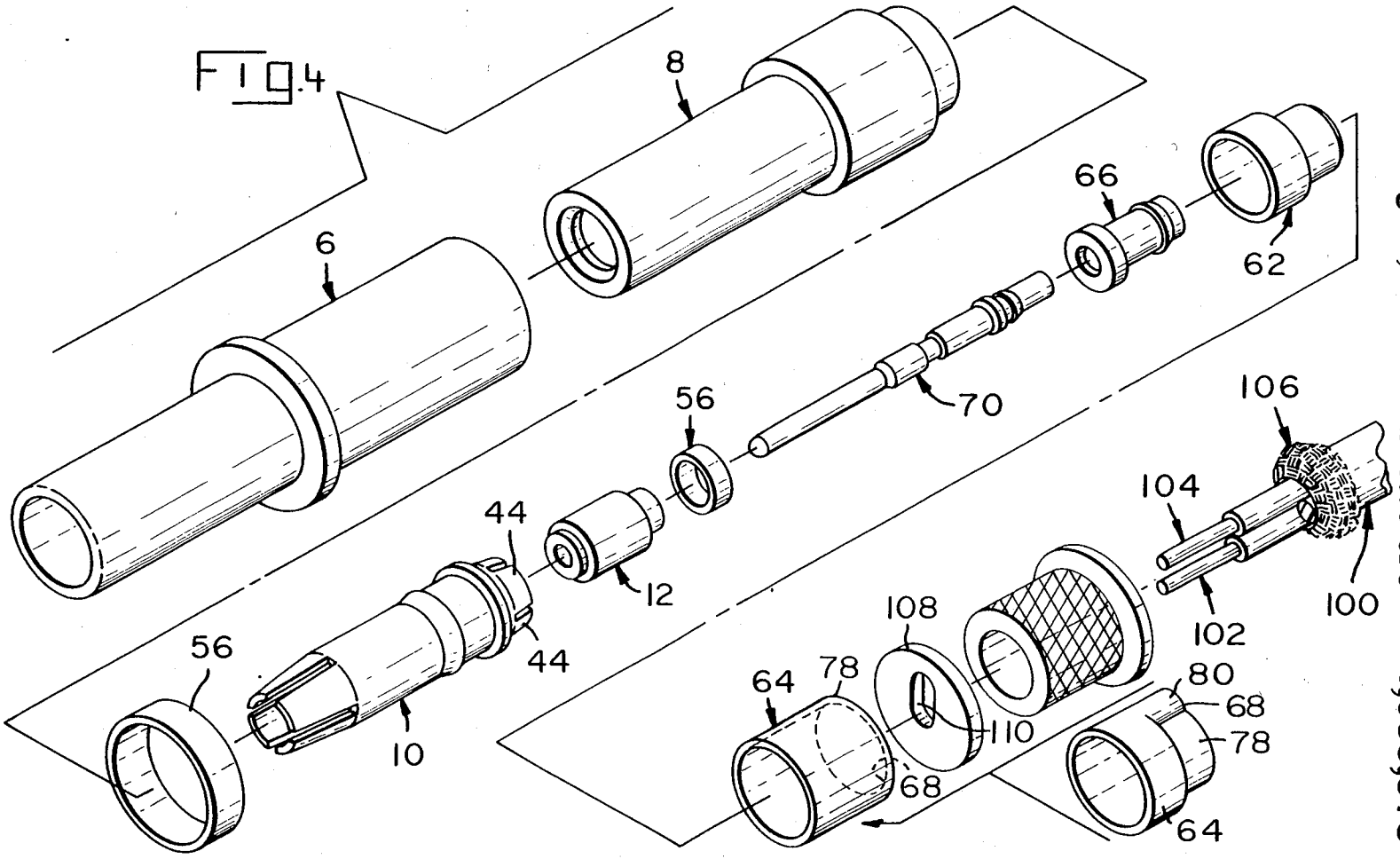
FIG. 4 is a fragmentary perspective view of the connector shown in FIG. 1 with component parts illustrated in exploded configuration.
Figure 8:
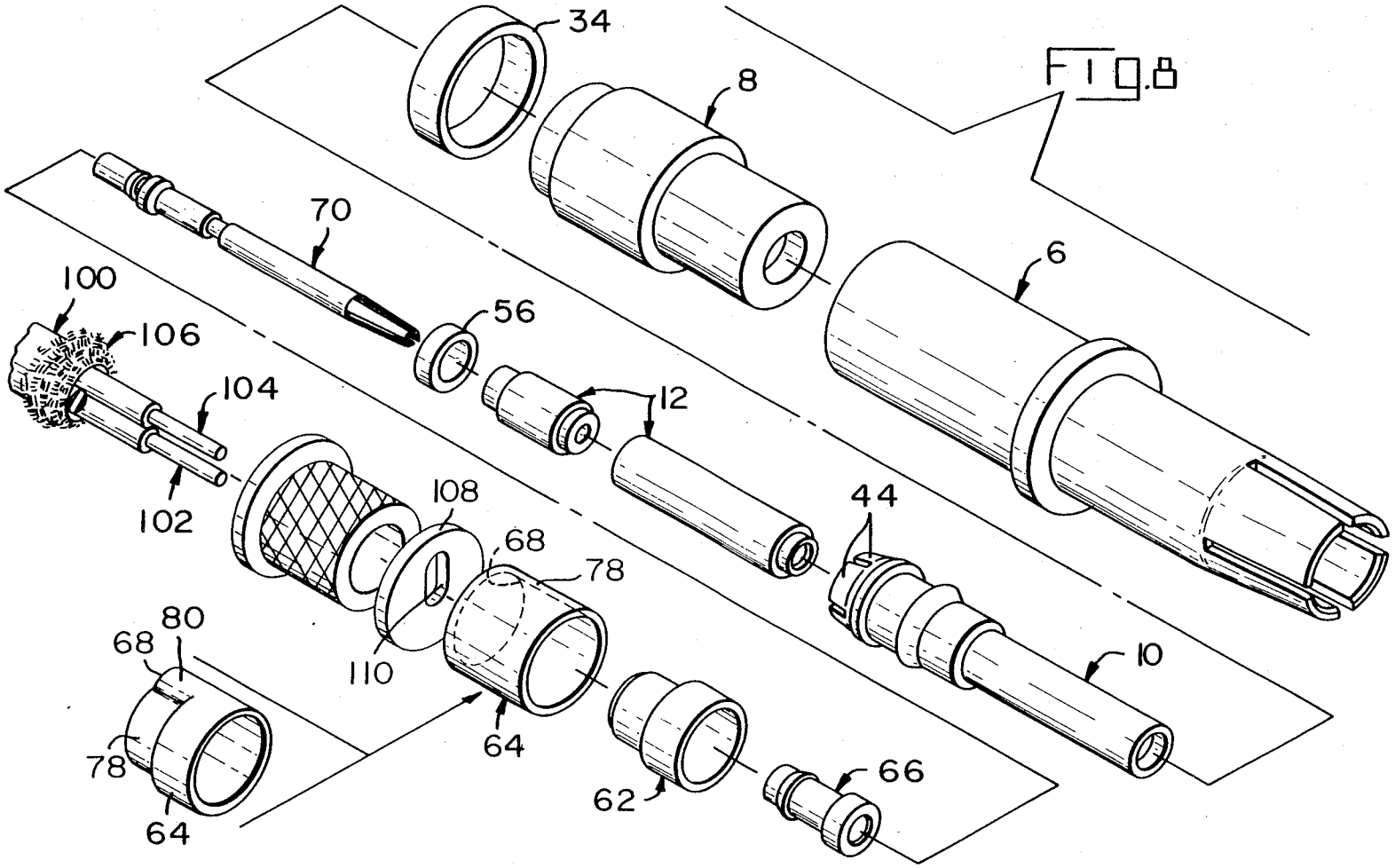
FIG. 8 is a fragmentary perspective view of the connector shown in FIG. 5 with component parts illustrated in exploded configuration.

An electrical plug type connector 1 is shown in FIG. 1. FIG. 4 illustrates the component parts of the connector 1. An electrical receptacle type connector 2 is shown in FIG. 5. FIG. 8 illustrates the component parts of the connector 2. The component parts of the connectors 1 and 2 are similar. In the text that follows, the same reference numerals are used in reference to the similar component parts of the connectors 1 and 2.

Figure 2:
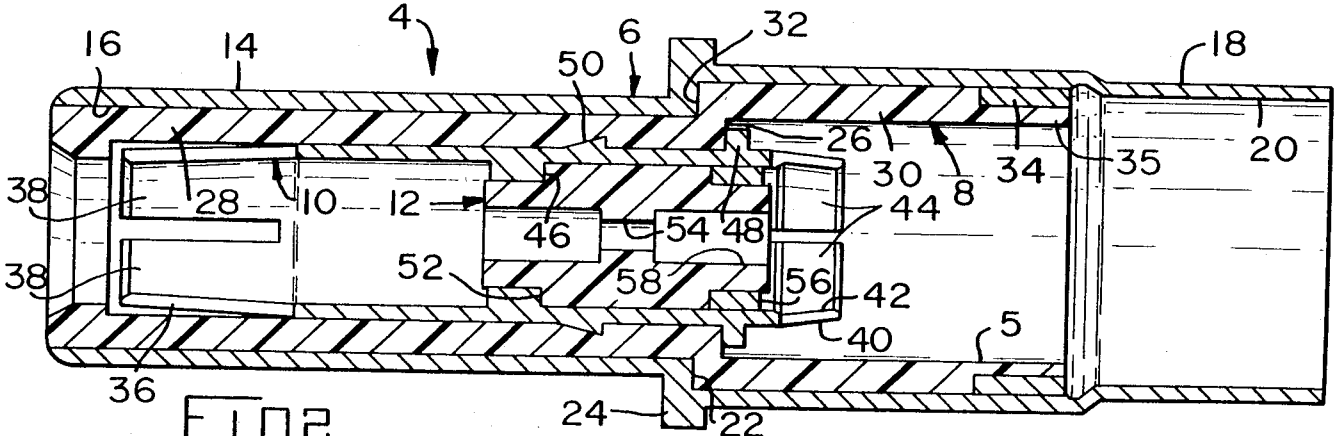
FIG. 2 is a section view of an assembly of some of the component parts of the connector shown in FIG. 1.
Figure 3:
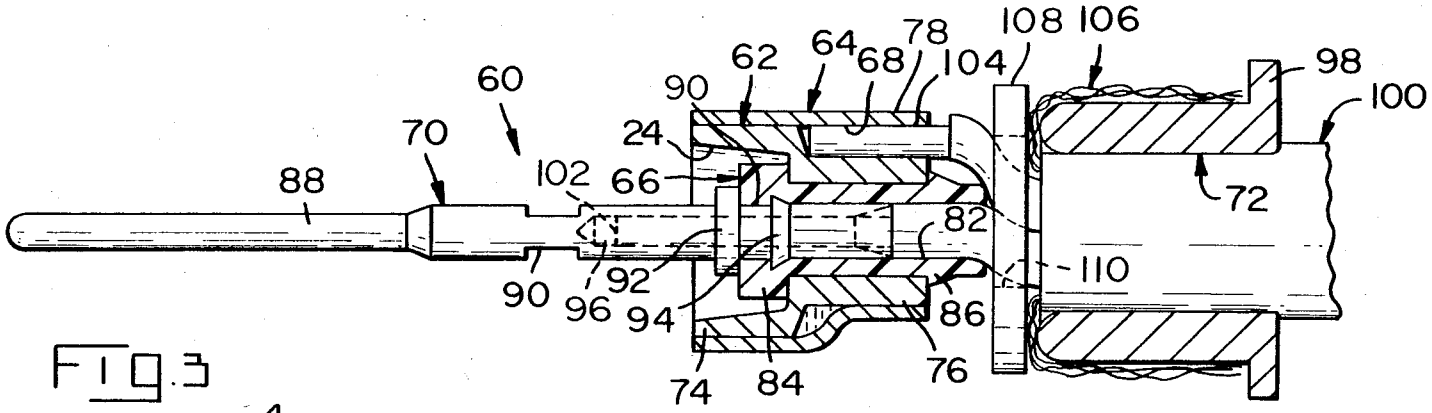
FIG. 3 is a section view of another assembly of some of the component parts of the connector shown in FIG. 1.
Figure 6:
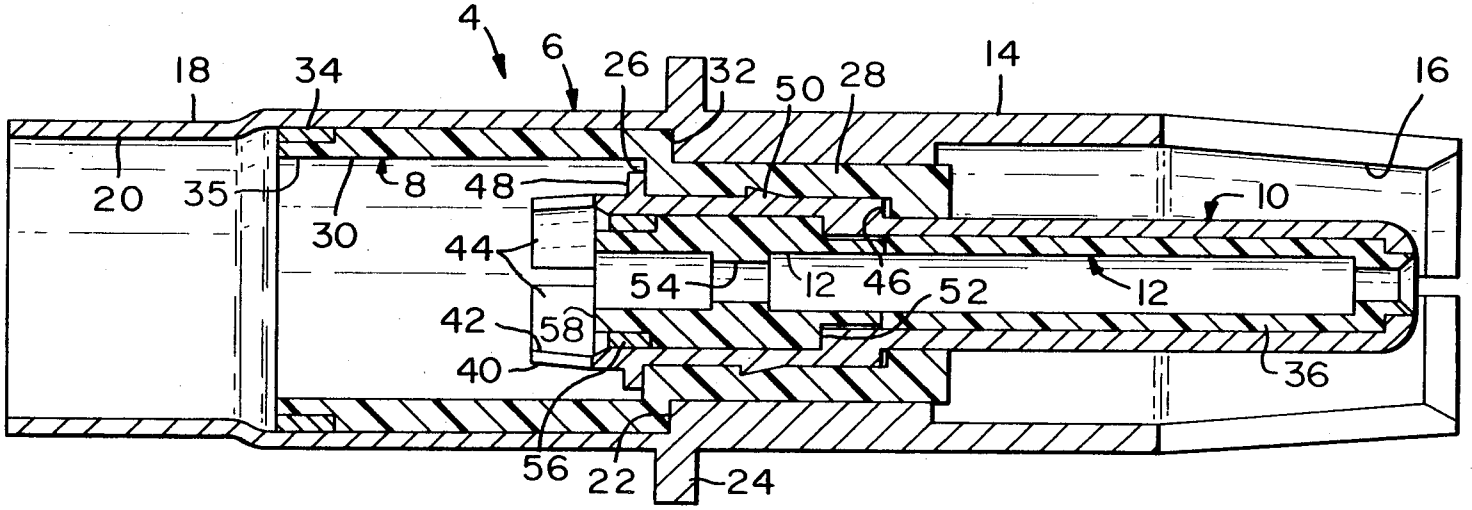
FIG. 6 is a section view of an assembly of some of the component parts of the connector shown in FIG. 5.
Figure 7:
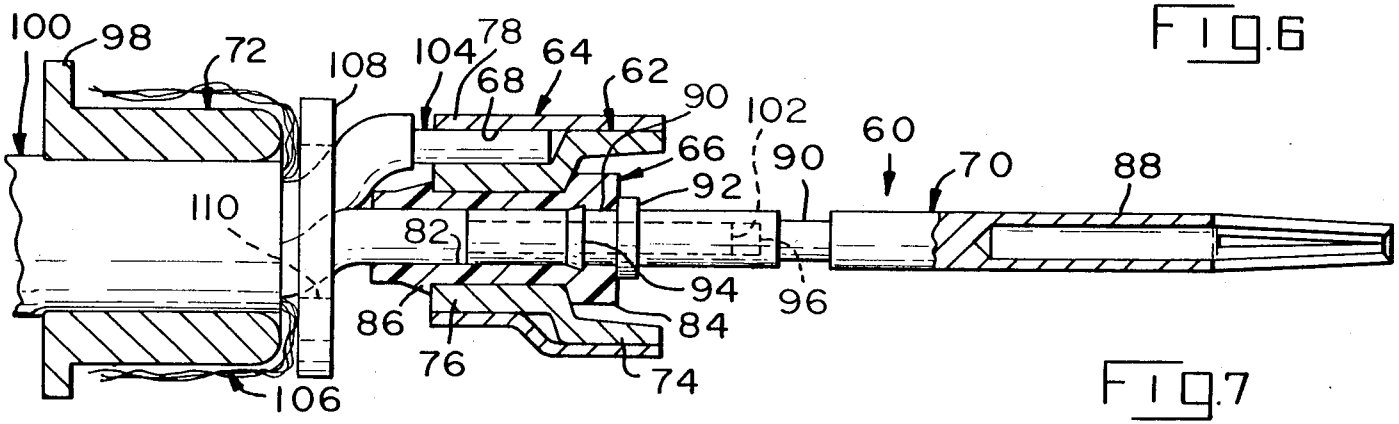
FIG. 7 is a section view of another assembly of some of the component parts of the connector shown in FIG. 5.

FIGS. 2 and 3 illustrate the component parts of the connector 1 in corresponding assemblies. FIGS. 6 and 7 illustrate the component parts of the connector 2 in corresponding assemblies. A first assembly 4 comprises an outer conductive shell 6, a first dielectric body 8 concentrically engaging the outer shell 6, a conductive inner shell 10 concentrically engaging the first dielectric body 8, and a second dielectric body 12 concentrically engaging the inner shell 10. For the receptacle connector 2, the second dielectric body 12 comprises two pieces.

The outer shell 6 is hollow and has a forward section 14 with an open end 16. The outer shell 6 has a rearward section 18 with an rearward open end 20. The internal diameter of the rearward section 18 is relatively large to receive additional component parts of the assembly 4. An internal annular shoulder 22 and an external mounting flange 24 are provided on the rearward section 18 of the outer shell 6.

The first dielectric body 8 is hollow and has an internal annular shoulder 26 between a forward section 28 and a rearward section 30 that has an internal diameter larger than the diameter of the forward section 28. The dielectric body 8 is mounted in the outer shell 6 by movement into the rearward open end 20 of the outer shell 6 and in a forward direction until an external annular shoulder 32 on the dielectric body 8 engages the shoulder 22 of the outer shell 6 to resist forward movement of the dielectric body 8.

A ring 34 is mounted in the rearward open end 20 and is frictionally retained with a compression fit against an interior of the outer shell 6. The ring 34 engages a rearward end 35 of the first dielectric body 8 and resists movement of the first dielectric body 8 in a rearward direction.

The conductive inner shell 10 concentrically engages the first dielectric body 8. The inner shell 10 is hollow and has a cylindrical forward section 36. On the plug connector 1 the forward section has a plurality of circumferentially spaced apart resilient fingers 38 that disengageably connect with and establish electrical connection with the forward section 36 of the receptacle connector 2.

A rearward section 40 of the inner shell 10 is frusto-conical and has an open rearward end 42 surrounded by rearwardly projecting tines 44 which are circumferentially spaced apart from one another. The inner shell 10 has an annular internal shoulder 46, a stop means in the form of an external flange 48 and an external tapered collar 50 with a rearward facing shoulder.

The inner shell 10 is assembled by movement into the open rearward end 20 of the outer shell 6 and the rearward open end 35 of the first dielectric body 8 until the flange 48 engages the internal shoulder 26 of the first dielectric body 8 to resist movement of the inner shell 10 in a forward direction. The first dielectric body 8 is resiliently compressible in response to forcible passage of the tapered collar 50. The collar 50 tapers forwardly to allow movement of the inner shell 10 within the first dielectric body 8 until the movement is resisted by the flange 48. The shoulder of the collar 50 imbeds in the dielectric body 8 to resist movement of the inner shell 10 in a rearward direction.

The second dielectric body 12 is assembled in the rearward open end 42 of the inner shell 10. An external annular shoulder 52 of the dielectric body 12 engages the annular internal shoulder 46 of the inner shell 10 to resist forward movement of the dielectric body 12. The dielectric body 12 is hollow and has an annular internal collar 54. A press-fit ring 56 is mounted in the rearward end 42 of the inner shell 10 and is frictionally retained by a compression fit against the interior surface of the inner shell 10. The press-fit ring 56 engages a rearward end 58 of the dielectric body 12 and resists movement of the dielectric body 12 in a rearward direction.

FIG. 3 illustrates a second assembly 60 corresponding to the connector 1. FIG. 7 illustrates a second assembly 60 corresponding to the connector 2. The corresponding assembly 60 comprises a first conductive body 62, a conductive and radially deformable ferrule 64 concentrically engaging the first conductive body 62, and a third dielectric body 66 concentrically engaging the first conductive body 62. The ferrule 64 has a conductor receiving receptacle portion 68 between the ferrule 64 and the first conductive body 62 for electrical connection to an insulated conductor of a twin axial electrical cable. Additional parts of the second assembly 60 comprise a conductive electrical contact 70 for connection to a first insulated conductor of a twin axial cable, a second conductive body 72 for connection to a conductive sheath or braid of the cable and an insulative barrier 108 having a conductor receiving opening 110.

The first conductive body 62 is hollow and has forward section 74 and a rearward section 76 of smaller diameter than the diameter of the forward section 74. An interior surface of the forward section 74 is frusto-conical and complementary in shape to receive the frusto-conical rearward section 40 of the inner shell 10. The ferrule 64 is hollow and surrounds the conductive body 72 and is frictionally mounted by a compression fit on the forward section 74.

One form of the ferrule 64 has a cylindrical rearward section 78 that defines a conductor receiving receptacle 68 of annular form adjacent to the rearward section 76. An alternate form of the ferrule 64 has a rearward section 78 with a raised portion 80 that projects outwardly from the surface of the rearward section 76 to define a conductor receiving receptacle 68 of elongate form adjacent to the rearward section 76.

The third dielectric body 66 has an axial passageway 82 for mounting the electrical contact 70. The dielectric body 66 has a forward section 84 of enlarged diameter within the forward section 74 of the first conductive body 62 and engages the forward section 74 to resist movement of the dielectric body 66 in a rearward direction. A tapered collar 86 projects radially outward of the dielectric body 66 and engages the rearward end of the conductive body 62 to resist movement of the dielectric body 66 in a forward direction. The collar 86 tapers rearwardly to allow passage of the dielectric body 66 in a rearward direction through the conductive body 62 until such movement is resisted by the forward section 84. The dielectric body 66 is radially compressible during assembly in the conductive body 62 to allow passage of the collar 86 along the interior of the rearward section 76.

Figure 9:
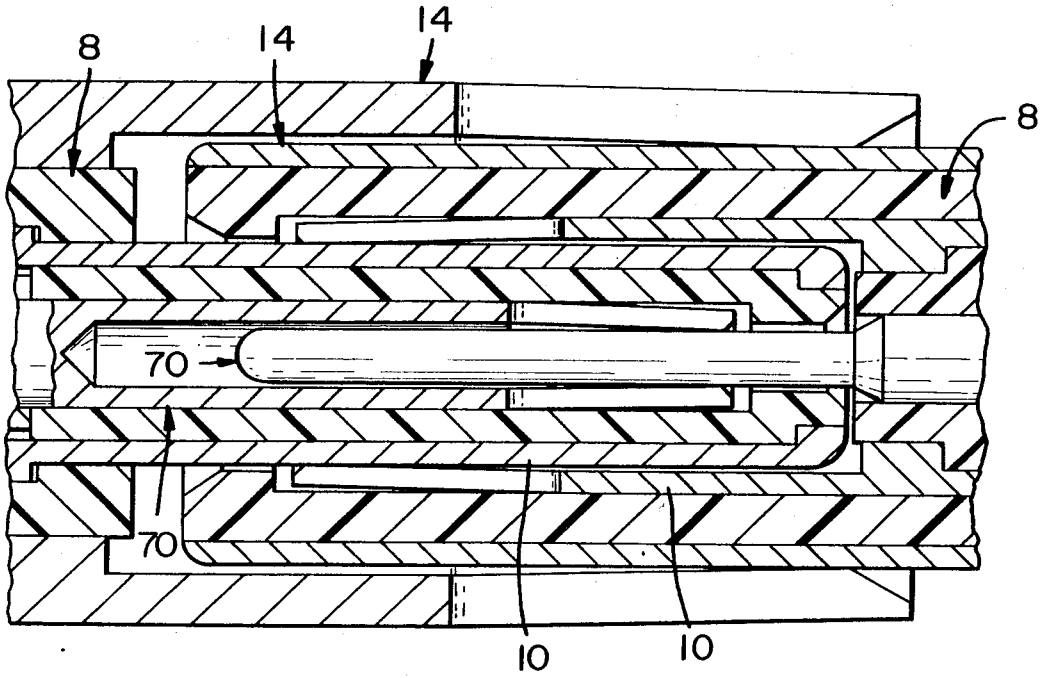
FIG. 9 is a fragmentary view in section illustrated the plug and receptacle connectors disengageably connected together.

For the plug connector 1, the corresponding electrical contact 70 has a forward section 88 in the form of an electrical plug. For the receptacle connector 2, the corresponding electrical contact 70 has a forward section 88 in the form of an electrical receptacle that disengageably connects with the plug when the connectors 1 and 2 are disengageably connected as shown in FIG. 9. Each corresponding contact 70 has an annular groove 90 and an annular external flange 92 and a tapered external collar 94. The flange 92 engages the dielectric body 66 and resists further rearward movement. The tapered collar 94 imbeds in the dielectric body 66 and resists forward movement of the contact 70. A conductor receiving cavity 96 is in the rearward end of the contact 70 for electrical connection with an insulated conductor of a twin axial electrical cable.

The second conductive body 72 is of hollow cylindrical form and is adapted for mounting in the rearward end 20 of the outer shell 6. The conductive body 72 has a flange 98 projecting radially outward to engage the rearward end 20 of the outer shell 6 and to resist forward movement of the conductive body 72 in the outer shell 6.

The second assembly 60 is connected with a twin axial electrical cable 100 in the following manner. The conductive second body 72 is assembled over the cable 100 such that the second body 72 surrounds the cable 100.

The barrier 108 is assembled over the conductors 102 and 104, making certain that the conductive sheath 106 is positioned on the same side of the barrier 108 as the conductive body 72, and that the conductors 102 and 104 project through the conductor receiving opening 110 of the barrier 108.

A first insulated conductor 102 of the cable 100 is inserted through the third dielectric body 66 and into the cavity 96 of the contact 70. A second insulated conductor 104 of the cable 100 is inserted in an open rearward end of the ferrule 64 and in the receptacle portion 68 of the ferrule 64. An electrical connection to the second conductor 104 is established by the application of radial inward force on the ferrule 64, causing the ferrule 64 to deform radially inward and engage the second conductor 104. The first conductor 102 and the contact 70 are connected electrically by the application of radial inward force on respective portions of the current 70 and the cavity 96 containing the first conductor 102 that projects forwardly outward of the third dielectric body 66 and the conductive body 62 and the ferrule 64. The conductive sheath 106 of the cable is doubled back on itself to surround externally and concentrically the second conductive body 72. Thereby the second assembly 60 is assembled to corresponding portions of the cable 100 and is duly prepared for assembly with the first assembly 4.

The second assembly 60 and the corresponding portions of the cable 100 are inserted in the open rearward end 20 of the outer shell 6. The contact 70 becomes supported in the second dielectric body 12, and the ferrule 64 becomes supported in the first dielectric body 8. The tines 44 of the inner shell 10 wedge against and engage the frusto-conical forward section 74 of the first conductive body 62 to resist further forward movement of the first conductive body 62 and to establish an electrical connection. The contact 70 is mounted in the second dielectric body 12 with the collar 54 locked in the groove 90. The second conductive body 72 and a corresponding portion of the sheath 106 are inserted in the open rearward end 20 of the outer shell 6. Radial inward force is applied to the rearward section 18 of the shell 6 to deform the shell 6 radially inward to engage concentrically the conductive sheath 106 and establish an electrical connection of the sheath 106 with the outer shell 6 and the second conductive body 72.

The barrier 108 is inserted in the rearward end 20 of the outer shell 6, and spans across the diameter of the rearward end 20 to confine the conductive body 72 and the conductive sheath 106 rearwardly of the barrier 108. Thereby the barrier 108 limits movement of the sheath 106 forwardly within and along the outer shell 6, and further prevents conductive contact of the sheath 106 with the conductors 102, 104 and the conductive parts which establish electrical connections to the respective conductors 102, 104.

The invention is intended to include other modifications and variations. For example, the first and second insulated conductors of the twin axial cable can be connected by the application of crimping forces simultaneously to the ferrule 64 and the contact 70.

We claim:

1. In an electrical connector for connection to corresponding conductors of an electrical cable, and comprising, a conductive outer shell for connection to a conductive sheath of an electrical cable, a first dielectric body concentrically surrounded by the outer shell, a conductive inner shell surrounded by the first dielectric body, a second dielectric body surrounded by the inner shell, a conductive body for insertion in a rearward section of the first dielectric body, a conductive ferrule engaging the conductive body and defining a receptacle portion for connection to a corresponding first conductor of the cable, a third dielectric body concentrically surrounded by the conductive body, and a conductive electrical contact concentrically surrounded by the third dielectric body for connection to a corresponding second conductor of the cable, the improvement comprising:

the ferrule, the conductive body, the third dielectric body and the contact being in permanent connection together to form a subassembly prior to connection of the ferrule and the electrical contact with the corresponding first and second conductors, the subassembly being constructed for movement along the interior of the first dielectric body into conductive engagement with the inner shell.

2. In an electrical connector as recited in claim 1, the improvement further comprising, the ferrule being deformable inwardly toward the conductive body for connection to the first conductor, the contact having a conductor receiving cavity for receipt of the second conductor, the conductor receiving cavity extending along a portion of the contact constructed to receive radial inward force for connection to the second conductor, and said portion of the contact projecting outwardly of the dielectric body, the conductive body and the ferrule.

3. In an electrical connector as recited in claim 1, the improvement further comprising, the outer shell, the first dielectric body, the inner shell and the second dielectric body being in permanent connection together prior to conductive engagement of the subassembly with the inner shell.

4. In an electrical connector as recited in claim 3, the improvement further comprising, the contact having a conductor receiving cavity for receipt of the second conductor, and said cavity and said receptacle are positioned on said subassembly for simultaneous connection of said ferrule and said contact to said corresponding first and second conductors.

5. In an electrical connector as recited in claim 3, the improvement further comprising, the inner shell and the conductive body being constructed for overlapped wedged engagement with each other.

6. In an electrical connector as recited in claim 3, the improvement further comprising, a second conductive body constructed for insertion in concentric relationship with the rearward section of the outer shell for connection with the conductive sheath of the cable.

7. In an electrical connector as recited in claim 3, the improvement further comprising, the ferrule being deformable inwardly toward the conductive body for connection to the first conductor, the contact having a conductor receiving cavity for receipt of the second conductor, said cavity extending along a portion of the contact constructed to receive radial inward force for connection to the second conductor, and said portion of the contact projecting outwardly of the dielectric body, the conductive body and the ferrule.

8. In an electrical connector as recited in claim 1, the improvement further comprising, the contact having a conductor receiving cavity for receipt of the second conductor, and said cavity and said receptacle are positioned on said subassembly for simultaneous connection of said ferrule and said contact to said corresponding first and second conductors.

9. In an electrical connector as recited in claim 8, the improvement further comprising, the inner shell and the conductive body being constructed for overlapped wedged engagement with each other.

10. In an electrical connector as recited in claim 8, the improvement further comprising, a second conductive body constructed for insertion in concentric relationship with the rearward section of the outer shell for connection with the conductive sheath of the cable.

11. In an electrical connector as recited in claim 8, the improvement further comprising, the ferrule being deformable inwardly toward the conductive body for connection to the first conductor, said cavity extending along a portion of the contact constructed to receive radial inward force for connection to the second conductor, and said portion of the contact projecting outwardly of the dielectric body, the conductive body and the ferrule.

12. In an electrical connector as recited in claim 1, the improvement further comprising, the inner shell and the conductive body being constructed for overlapped wedged engagement with each other.

13. In an electrical connector as recited in claim 12, the improvement further comprising, a second conductive body constructed for insertion in concentric relationship with the rearward section of the outer shell for connection with the conductive sheath of the cable.

14. In an electrical connector as recited in claim 12, the improvement further comprising, the ferrule being deformable inwardly toward the conductive body for connection to the first conductor, the contact having a conductor receiving cavity for receipt of the second conductor, said cavity extending along a portion of the contact constructed to receive radial inward force for connection to the second conductor, and said portion of the contact projecting outwardly of the dielectric body, the conductive body and the ferrule.

15. In an electrical connector as recited in claim 1, the improvement further comprising, a second conductive body constructed for insertion in concentric relationship with the rearward section of the outer shell for connection with the conductive sheath of the cable.

16. In an electrical connector as recited in claim 15, the improvement further comprising, the ferrule being deformable inwardly toward the first recited conductive body for connection to the first conductor, the contact having a conductor receiving cavity for receipt of the second conductor, said cavity extending along a portion of the contact constructed to receive radial inward force for connection to the second conductor, and said portion of the contact projecting outwardly of the dielectric body, the first recited conductive body and the ferrule.

17. In an electrical connector as recited in claim 15, the improvement further comprising, an insulative barrier sized to fit within the outer shell and having a thickness fitting in a space within the outer shell and separating the second conductive body from both the ferrule and the first recited conductive body.

* * * * *